US007758404B1

(12) United States Patent
Ryder et al.

(10) Patent No.: US 7,758,404 B1
(45) Date of Patent: Jul. 20, 2010

(54) APPARATUS FOR CLEANING EDGE OF SUBSTRATE AND METHOD FOR USING THE SAME

(75) Inventors: Jason A. Ryder, Oakland, CA (US); Ji Zhu, El Cerrito, CA (US); Mark Wilcoxson, Oakland, CA (US); Fritz Redeker, Fremont, CA (US); John P. Parks, Hercules, CA (US); Charles Ditmore, Oakland, CA (US); Jeffrey G. Gasparitsch, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 1279 days.

(21) Appl. No.: 11/253,118

(22) Filed: Oct. 17, 2005

(51) Int. Cl.
*B24B 1/00* (2006.01)

(52) U.S. Cl. ..... 451/246; 451/44; 451/446; 451/254; 451/526; 15/77; 15/88.1; 15/102

(58) Field of Classification Search ..... 451/43, 451/44, 54, 59, 60, 195, 242, 246, 446, 450, 451/254, 526, 533, 913; 15/77, 88.1, 102
See application file for complete search history.

(56) References Cited

U.S. PATENT DOCUMENTS 6,267,649 B1 * 7/2001 Lai et al. ..... 451/44
6,334,229 B1 1/2002 Moinpour et al.
6,422,930 B2 * 7/2002 Hakomori ..... 451/325
6,454,644 B1 * 9/2002 Miyazaki et al. ..... 451/526
6,550,091 B1 4/2003 Radman et al.
6,910,240 B1 6/2005 Boyd et al.
7,367,873 B2 * 5/2008 Ishii et al. ..... 451/168
2005/0150172 A1 * 7/2005 Sato ..... 51/298
2007/0148914 A1 * 6/2007 Morita et al. ..... 438/458

* cited by examiner

*Primary Examiner*—Eileen P. Morgan
(74) *Attorney, Agent, or Firm*—Martine Penilla & Gencarella, LLP

(57) ABSTRACT

An apparatus, system and method for cleaning a substrate edge include a composite applicator that cleans bevel polymers deposited on wafer edges using frictional contact in the presence of fluids. The composite applicator includes a support material and a plurality of abrasive particles distributed within and throughout the support material. The composite applicator cleans the edge of the wafer by allowing frictional contact of the plurality of abrasive particles with the edge of the wafer in the presence of fluids, such as liquid chemicals, to cut, rip and tear the bevel polymer from the edge of the wafer.

12 Claims, 5 Drawing Sheets

APPARATUS FOR CLEANING EDGE OF SUBSTRATE AND METHOD FOR USING THE SAME

CROSS REFERENCE TO RELATED APPLICATIONS

This application is related to co-pending U.S. patent application Ser. No. 11/242,705, filed on Oct. 3, 2005, and entitled "Method and Apparatus for cleaning a wafer bevel edge and notch using a pin and an abrasive film cassette," which is incorporated herein by reference.

BACKGROUND

1. Field of the Invention

The present invention relates generally to semiconductor wafer processing, and more particularly, to a method and apparatus for cleaning substrate edges before, during and after fabrication operations.

2. Description of the Related Art

In the semiconductor chip fabrication process, it is well known that there is a need to clean the surface of the substrate (e.g., wafer) of unwanted residues to maximize the yield of defect-free chips. Unwanted residues are sometimes left behind during fabrication operations. Examples of fabrication operations include plasma etching, material depositions, and chemical mechanical planarization (CMP). CMP is a typical polishing technology and is performed on both dielectric and conductive materials.

During the plasma etching process, the surface of the wafer exposed to the plasma is etched. The etching produces byproducts due to the physical and chemical reactions of the etch gases and the materials being etched. The byproducts can adhere to the wafer edge, bevel and underside where the ion bombardment is minimal. In the deposition process, metals are commonly deposited over previously formed dielectric features such as interconnect trenches and vias. During this deposition, it is possible that excess metal material is inadvertently deposited on the edge of the wafer. During the CMP process, chemical slurries such as silica-based slurry, dispersed silica, fumed or dispersed alumina are used to facilitate the removal of oxides and metals. Residues from the CMP process are also likely to adhere to the edges of the wafer, even after some later cleaning steps. The residue materials and particles noted above will tend to orient themselves on unprotected portions of the wafer and condense along the edge, notch, edge exclusion regions and the underside of the wafer. These residues tend to harden over the fabrication cycles and will result in what is referred to as "bevel polymer", due to their structure and chemical composition. Bevel polymers have unique properties, in that they adhere to each other and to the wafer surface with a strong bond, and the bond is relatively hard to break. If the bevel polymer is not removed during wafer processing, the bevel polymer may flake off and can deposit on surfaces of other wafers during wafer transport and storage. Further, the flakes can cause defects, such as scratches on the wafer surfaces, inappropriate interactions between metallization features, etc. These defects have the downside of causing yield loss.

Several well-known techniques have been suggested and implemented to address the issue of cleaning the wafer edges with varying degrees of success. Brush scrubbing and edge scrubbing techniques have been used. However, these techniques use soft materials (e.g., polyvinyl alcohol 'PVA') that are designed to prevent scratching of the wafer surface. Thus, these soft materials are not capable of breaking the strong bond of the bevel polymers deposited on the wafer edges.

In view of the foregoing, there is a need for an apparatus and method for enhancing wafer edge cleaning.

SUMMARY

The present invention fills the need by providing an improved apparatus, system and method for cleaning bevel polymer deposited on a wafer edge. It should be appreciated that the present invention can be implemented in numerous ways, such as a process, an apparatus, a system, a device or a method.

The present invention provides a composite applicator that cleans bevel polymers deposited on wafer edges using frictional contact. The composite applicator includes a support material and a plurality of abrasive particles distributed throughout and within the support material. The composite applicator cleans the edge of the wafer by allowing frictional contact of the plurality of abrasive particles with the edge of the wafer in the presence of liquid chemicals to cut, rip, and tear the bevel polymer from the wafer edge.

One embodiment includes a system for cleaning bevel polymers deposited on wafer edges. In this system, a substrate supporting device is used to receive and support the wafer in a selected plane. A composite applicator, having a support material and a plurality of abrasive particles, is brought in frictional contact with the edge of the wafer to scrub the bevel polymer build-up on the edge of the wafer. The abrasive particles have a hardness level greater than a hardness level of the bevel polymer. The frictional contact of the abrasive particles and a fluid, such as liquid chemicals, introduced into or on to the support material help in breaking up the bevel polymer build-up on the wafer edge during cleaning process.

Another embodiment includes a method to clean an edge of a substrate. The method includes applying an edge of a substrate, with bevel polymer build-up, to a composite material defined by a support material in which a plurality of abrasive particles is distributed. The abrasive particles have a hardness level greater than a hardness level of the bevel polymer. A fluid, such as liquid chemicals, is applied to the support material within the composite material to assist in breaking up the bevel polymer build-up on the wafer edge and to provide lubrication to the wafer surface during the cleaning process. Exposing the wafer edge to liquid chemicals while simultaneously having the abrasive particles in frictional contact with the edge of the wafer helps in cutting and tearing the bevel polymer from the edge of the wafer.

Other advantages of the present invention will become apparent from the following detailed description, taken in conjunction with the accompanying drawings, illustrating the principles of the present invention.

BRIEF DESCRIPTION OF THE DRAWINGS

The invention may best be understood by reference to the following description taken in conjunction with the accompanying drawings. These drawings should not be taken to limit the invention to the preferred embodiments, but are for explanation and understanding only.

DETAILED DESCRIPTION

Several embodiments for an improved and more effective wafer edge cleaning apparatus, system and method will now be described. It will be obvious, however, to one skilled in the art, that the present invention may be practiced without some or all of these specific details. In other instances, well known process operations have not been described in detail in order not to unnecessarily obscure the present invention.

Wafer edge cleaning apparatus, systems and methods are very important to the ultimate quality of the resulting semiconductor products, e.g., microchips. In the present invention, the bevel polymers deposited on the wafer edges are treated with mechanical and chemical scrubbing that cuts, tears and removes the bevel polymers from the wafer edge.

In this document, the term wafer and substrate are used inter-changeably to refer to a thin slice of a semi-conductor material (usually silicon), from which microchips are made. The substrate can also be a flat panel substrate, which typically takes on a rectangular or square shape. In this document, the term composite material and composite applicator are used inter-changeably to refer to a compliant and porous support material in which a plurality of abrasive particles is distributed.

Figure 1A:
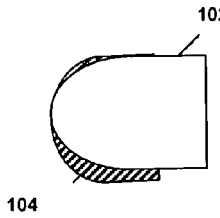
FIGS. 1*a*, 1*b* and 1*c* illustrate edge of a wafer before, during and after cleaning process.
Figure 1B:
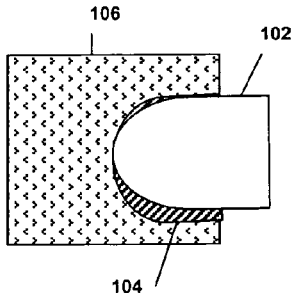
Figure 1C:
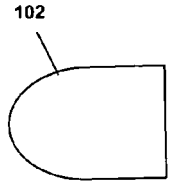

FIG. 1*a* shows an edge of a wafer 102 with a bevel polymer 104 before the cleaning process. As shown, the bevel polymer 104 is formed on the outer curvature and back underside curvature of the edge of the wafer 102 with more concentration on the back underside curvature of the edge of the wafer 102. This concentration of the bevel polymer 104 is common due to the nature of the fabrication operations and the placement of the wafer 102 in various tools during different stages of the fabrication process. FIG. 1*b* shows the edge of the wafer 102 during the cleaning process. FIG. 1*b* shows the edge of wafer 102 being received by the composite applicator 106 and placed in frictional contact with a plurality of abrasive particles 105 distributed within the composite applicator 106. Although the drawing illustrated in FIG. 1*b* reflects a single composite applicator, a plurality of applicators could be used to apply force at various angles to the wafer edge. The composite applicator 106 efficiently cleans the bevel polymer 104 from the edge of wafer 102 irrespective of where the bevel polymer 104 is deposited and delivers a substantially or completely bevel-polymer-free wafer 102, as shown in FIG. 1*c*.

Figure 2A:
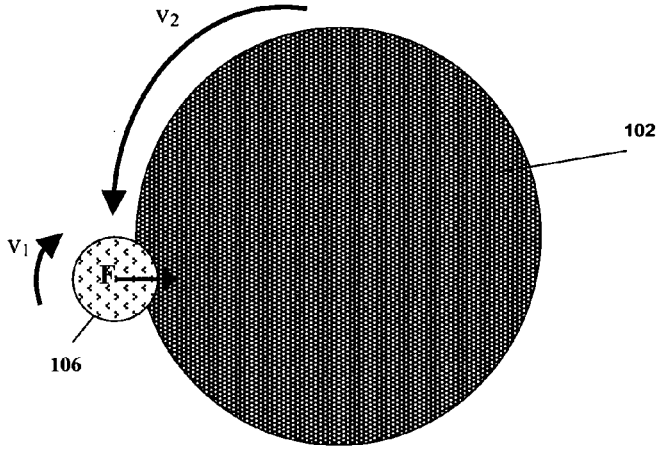
FIG. 2*a* illustrates the top view of the composite applicator of the present invention.

FIG. 2*a* shows a top view of a substrate cleaning apparatus, in accordance with one embodiment of the present invention. The substrate cleaning apparatus includes a composite applicator 106 that is placed in frictional contact with an edge of a wafer 102. The composite applicator 106 is made of a support material that makes up the body of the composite applicator 106. The body of the support material is compliant so that when the edge of a wafer 102 is applied to the support material, the support material compresses allowing the wafer edge to be at least partially pressed into the support material. The support material also acts as a conduit for fluids, such as liquid chemicals, that aid in wafer edge cleaning. This is possible by having the support material made up of a porous material such as polyvinyl alcohol (PVA), polyurethane, polymer resin or foam.

Liquid chemicals are introduced and distributed within or on to the support material to provide lubrication to the wafer surface and to assist in the breakdown of bevel polymer 104. Continuous exposure to these liquid chemicals breaks down the bevel polymer 104 deposited on the wafer 102 surface. Some examples of liquid chemicals used and their composition that has shown promising results in the wafer edge cleaning process of the present embodiment are: a) about 1% to about 29% by weight of Ammonium hydroxide to de-ionized water; or b) about 1 part/1000 parts dilution of 49% by weight of hydrogen fluoride to de-ionized water. Hydrogen fluoride in aqueous solution of de-ionized water has proved effective for more aggressive cleaning of bevel polymer 104.

In addition to the support material, the composite applicator 106 includes a plurality of abrasive particles 105 distributed within and throughout the support material. The distribution of the plurality of abrasive particles 105 can be random or can be uniform. In this embodiment, the distribution of the plurality of abrasive particles 105 is considered random. The ratio of the plurality of abrasive particles 105 to the support material can depend on the bevel polymer 104 deposit and the level of frictional contact that is needed to scrape the bevel polymer 104 deposit from the edge of the wafer 102.

The plurality of abrasive particles 105 are chosen such that they are capable of removing the bevel polymer 104 from the edge of wafer 102 without scratching or damaging the surface of the wafer 102. One preferred method of achieving the goal is to include in the plurality of abrasive particles one that has a hardness level that is greater than hardness level of the bevel polymer 104 but less than hardness level of wafer 102 surface. The hardness level of at least one of the plurality of abrasive particles 105 is greater than the hardness level of the bevel polymer 104 to facilitate scrubbing and removal of the bevel polymer 104 from wafer edge. By keeping the hardness level of the abrasive particles 105 lower than the hardness level of the wafer 102 surface, the wafer 102 surface is protected from scratches and other damage. The hardness level of at least one of plurality of abrasive particles 105, that is known to work in this embodiment of the invention, is between about 3 Mohs and about 7 Mohs. Examples of abrasive particles 105 include titanium oxide, zirconium oxide, or amorphous silicon oxide.

Continuing reference to FIG. 2*a*, the composite applicator 106, in this embodiment, is fabricated as a wheel that can be placed in contact with the edge of the wafer 102. In one example, the profile of the composite applicator 106 can match the profile of the wafer edge. Further, the composite applicator 106 can adopt other configurations and shapes, and is therefore not confined to a wheel configuration. As shown, however, the composite applicator 106 is rotated at velocity v1 making tangential contact with edge of wafer 102 rotating at velocity $v_2$, with force F. The rotation of composite applicator 106 and edge of wafer 102 can be made possible by use of one or more motors attached to the composite applicator 106 and wafer 102 respectively, or by some other mechanical means. The composite applicator 106 can be positioned and rotated in other configurations other than the one illustrated in FIG. 2*a*. For example, the contact between the composite applicator 106 and wafer 102 edge could be horizontal, vertical from above, vertical from below, or at an angle. The rotation of composite applicator 106 verses the wafer 102 can be clockwise/clockwise, counter-clockwise/clockwise, clockwise/counter-clockwise or counter-clockwise/counter-clockwise, respectively.

In addition, the velocity $v_1$ and $v_2$ can be varied, so long as enough frictional contact is made between the abrasive particles 105 of the composite applicator 106 and the edge of the wafer 102. Further, it is desirable that hydroplaning between the composite applicator 106 and the wafer edge be reduced or controlled, so that the desired level of friction between the abrasive particles 105 of the composite applicator 106 and any bevel polymer 104 on wafer 102 edge is maintained. In this manner, a controlled amount of frictional force is imparted by the abrasive particles 105 of the composite applicator 106 on the bevel polymer 104, yet the abrasive particles 105 do not scratch the wafer 102. As noted above, the abrasive particles 105 are chosen such that at least one of the plurality of abrasive particles 105 has a hardness level that is greater than hardness level of the bevel polymer 104 but less than hardness level of wafer 102.

Figure 2B:
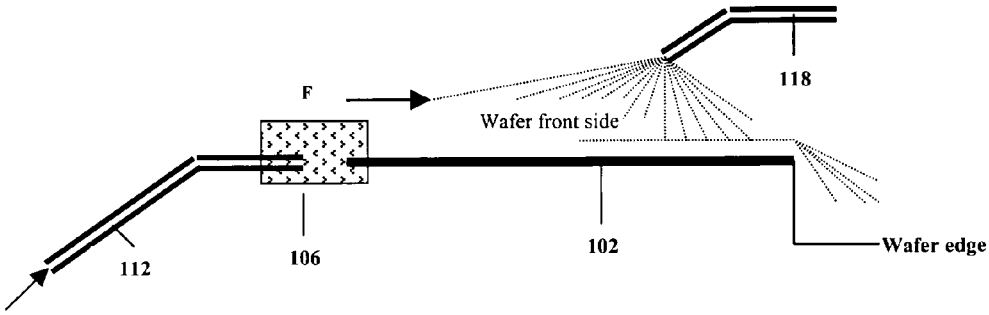
FIG. 2*b* illustrates the side view of the composite applicator in FIG. 2*a*, with optional channel and nozzle, and an optional front side and wafer rinse, in one embodiment of the present invention.

FIG. 2*b* shows a side view of the composite applicator 106 in another embodiment of the invention. A wafer edge is received into the composite applicator 106. The depth of the wafer edge that is received is at least equal to the depth to which the bevel polymer 104 has built up on the wafer edge. In this embodiment, a channel 112 to introduce liquid chemicals into the support material is provided. Liquid chemicals are conducted through the channel 112 and introduced into the porous support material of the composite applicator 106. The channel 112 can be positioned anywhere so long as the function of introducing liquid chemicals to support material is met. The liquid chemicals are distributed throughout the porous support material and provide lubrication to the surface of the wafer 102 during cleaning and facilitate breakdown of bevel polymer 104 from the wafer edge.

In one embodiment, a nozzle 118 is provided to spray the front side of the wafer 102 and wash away or dilute any liquid chemicals that may make their way on to the front side of wafer 102 during treatment with the composite applicator 106. As the wafer 102 is rotating, centrifugal force will assist in the removal of liquid chemicals from the front side of the wafer. The nozzle 118 can be used to spray fluids, such as de-ionized water, or gases, such as gaseous nitrogen, onto the front side of the wafer 102 under variable pressure. Other fluids or gases may also be used to clean the surface of the wafer 102 as long as these fluids or gases are capable of efficiently removing liquid chemicals from the front side of the wafer 102. The nozzle 118 can be placed anywhere in the apparatus so long as it is able to efficiently spray and remove any unwanted chemicals that may make their way onto the front side of the wafer 102. The liquid chemicals in the support material may make their way onto the front side of wafer and chemically react with materials on the wafer 102 surface, such as exposed metal lines. As an example, liquid chemicals, such as ammonium hydroxide, distributed within the support material (used to chemically assist in the cleaning of the edge) may chemically react with the exposed metals on the front side of the wafer, and thus, nozzle 118 will assist in reducing the possibility of such chemical reactions.

Figure 3A:
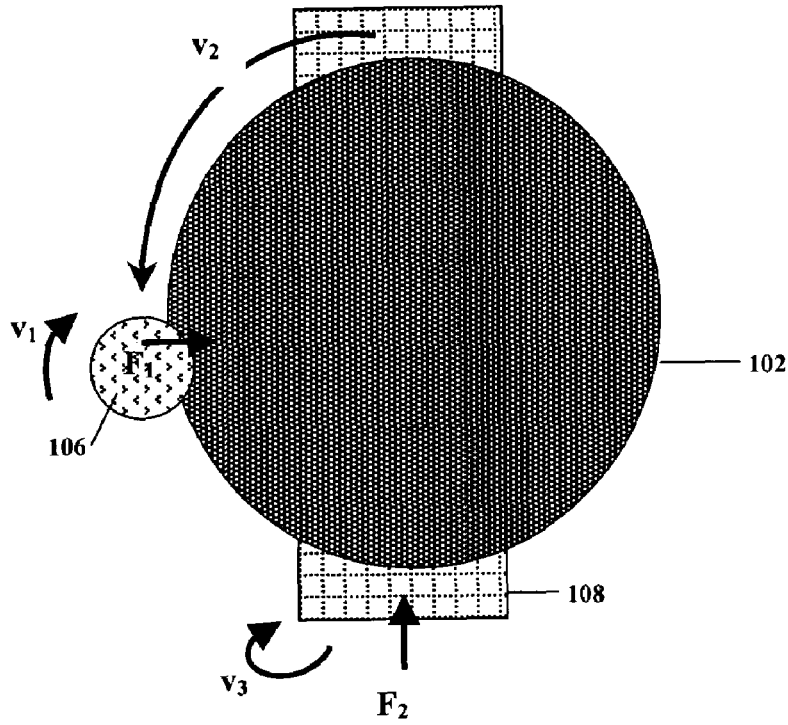
FIGS. 3*a* and 3*b* illustrate the top view and side view of the composite applicator with optional back brush, in one embodiment of the present invention.
Figure 3B:
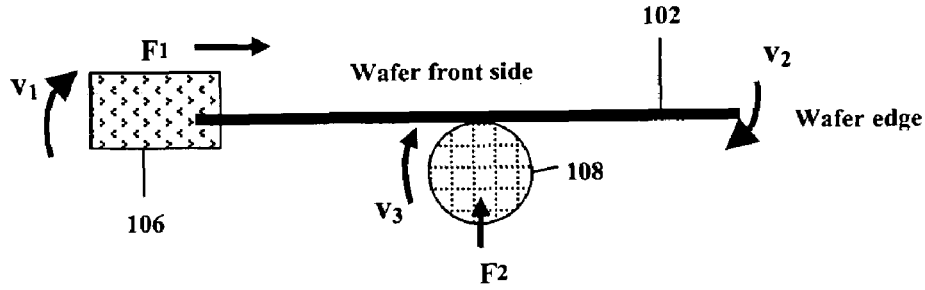

FIGS. 3*a* and 3*b* show the top view and side view of a substrate cleaning apparatus, in accordance with an alternate embodiment of the present invention. In this embodiment, a back brush 108 is positioned on a back side of wafer 102 to facilitate cleaning of the back side of wafer 102. The back brush 108 material is made of material similar to that of the support material and allows distribution of liquid chemicals to the under side of wafer 102. A channel 112 similar to the one shown in FIG. 2*b* can be used to introduce liquid chemicals into the support material of back brush 108. Composite applicator 106 is positioned to receive the edge of wafer 102. The depth of the wafer edge that is received is at least equal to the depth to which the bevel polymer 104 build up has occurred on the edge of wafer 102. In one embodiment, the composite applicator 106 in FIG. 3*a* is fabricated as a wheel that can be placed in contact with edge of the wafer 102. In one example, the profile of the composite applicator 106 can match the profile of the wafer edge. Further, the composite applicator 106 can adopt other configurations and shapes, and is therefore not confined to a wheel configuration.

As shown in FIGS. 3*a* and 3*b*, the composite applicator 106 is rotated at velocity $v_1$ making tangential contact with edge of wafer 102 rotating at velocity $v_2$ with force $F_1$ while simultaneously the wafer under side surface is in contact with the back brush 108 rotating at velocity $v_3$ with force $F_2$. The rotation of composite applicator 106, the back brush 108 and edge of wafer 102 can be made possible by use of one or more motors 124 attached to the composite applicator 106, back brush 108 and wafer 102 respectively, or by some other mechanical means. The composite applicator 106 and back brush 108 can be positioned and rotated in other configurations other than the one illustrated in FIGS. 3*a* and 3*b*. The velocity of the composite applicator 106, velocity of the wafer 102 and velocity of back brush 108 can be varied, so long as enough frictional contact is maintained between the abrasive particles 105 of the composite applicator 106 and the edge of the wafer 102 to get varied degrees of cleaning. As noted, the cleaning is designed such that the abrasive particles 105 in the composite applicator 106 are placed in frictional contact with the bevel polymer 104 formed on the edge of the wafer 102. Thus, the frictional contact of the abrasive particles 105 on the bevel polymer 104, with a sufficient amount of chemicals (introduced through the support material of the composite applicator 106), will beneficially clean the wafer 102 edge of the bevel polymer 104.

Figure 4A:
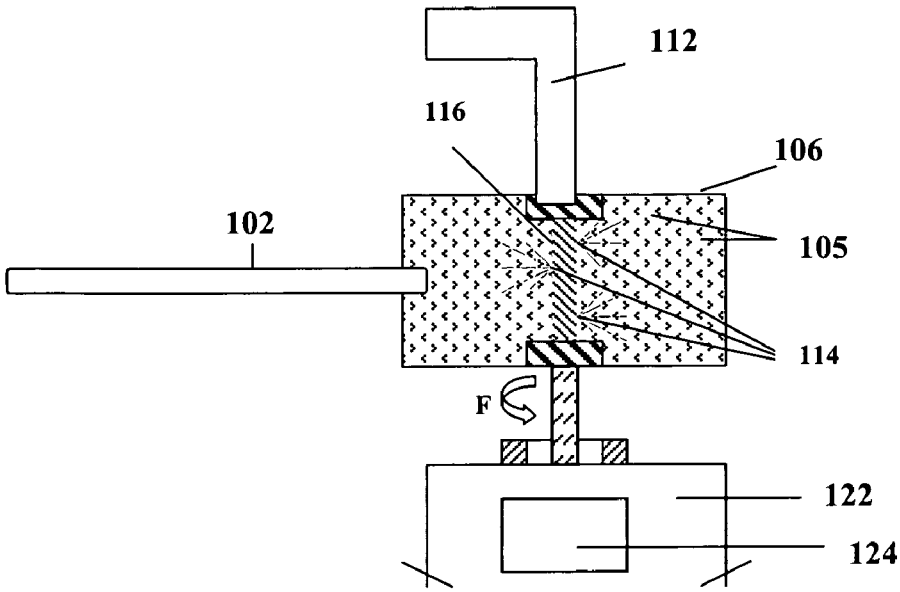
FIG. 4*a* illustrates the side cross-sectional view of a composite applicator receiving an edge of a wafer, in accordance with one embodiment of the present invention.

FIG. 4*a* illustrates the cross-sectional side view of a substrate cleaning apparatus, in accordance with one embodiment of the invention. In this embodiment, the edge of wafer 102 is received in a composite applicator 106. The depth of the wafer edge that is received is at least equal to the depth to which the bevel polymer 104 build up has occurred on the wafer edge. A channel 112, to introduce liquid chemicals into the support material of the composite applicator 106, is provided. A fluid distributor 116 is embedded within the support material of the composite applicator 106 to assist in the distribution of liquid chemicals introduced through channel 112 within the support material. The fluid distributor 116 has one or more apertures 114 to provide a flow path for the liquid chemicals into the support material of the composite applicator 106. The fluid distributor 116 is connected to the channel 112 at least at one end where it enters the support material. Channel 112 and fluid distributor 116 can be positioned anywhere within the substrate cleaning apparatus so long as they are able to introduce and conduct liquid chemicals into the supporting material of the composite applicator 106.

Figure 5:
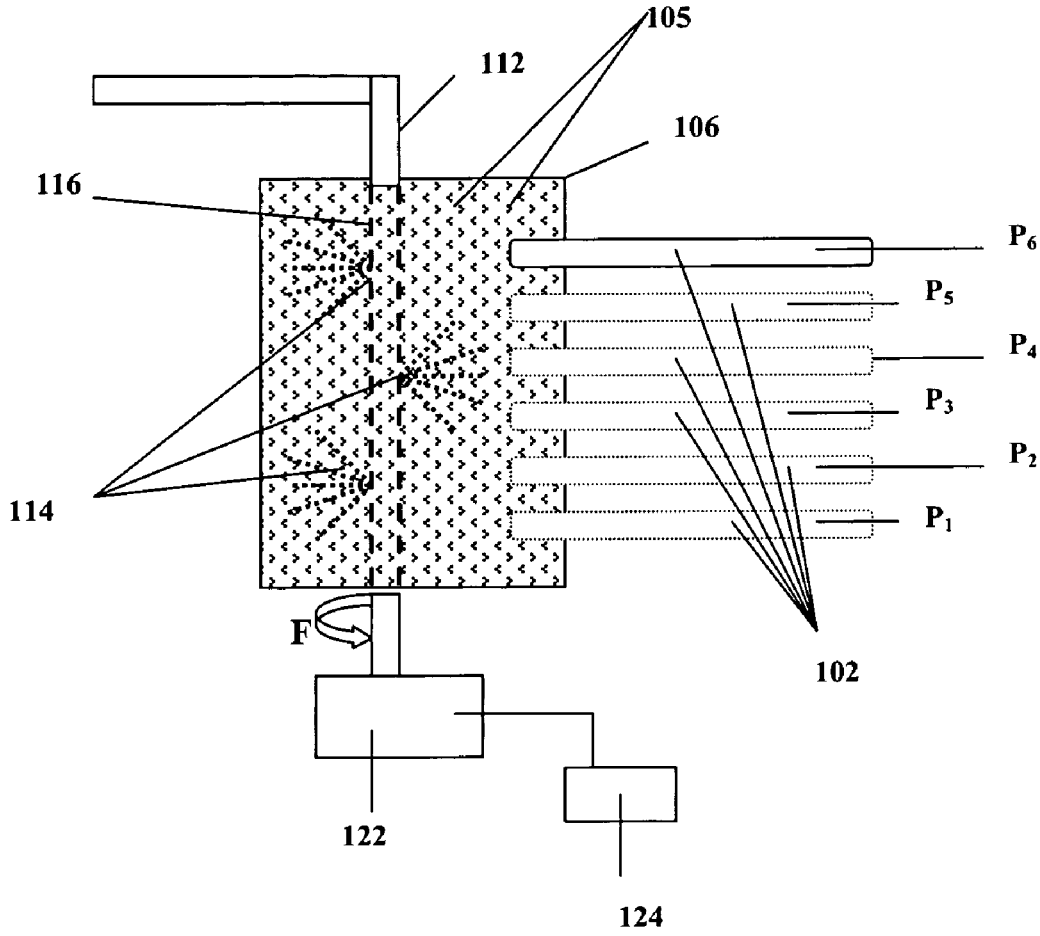
FIG. 5 illustrates the composite applicator mounted on an indexing mechanism using position controller.

Continuing to reference FIGS. 4*a* and 5, a position controller 122 is connected to the composite applicator 106. The position controller 122 allows rotation of the composite applicator 106 as well as indexing of the composite applicator 106 by either allowing the composite applicator 106 to move up/down along an axis or moving wafer 102 up/down so that the wafer 102 can be received at different positions on the composite applicator 106. This action of moving the composite applicator 106 up/down or moving the wafer 102 up or down allows a fresher surface of composite applicator 106 to be exposed to the wafer 102 edge for more effective cleaning. FIG. 5 shows an example of a wafer 102 being received at different positions during the cleaning process. $P_1$ refers to position 1 where wafer # 1 was received for cleaning, $P_2$ refers to position 2 where wafer # 2 was received, $P_3$ refers to position 3 where wafer # 3 was received and so on. The position controller 122 is connected to a motor 124 to allow the composite applicator 106 to spin on its axis at a desired velocity and to facilitate indexing during cleaning process. The apparatus is designed such that the abrasive particles 105 in the composite applicator 106 are placed in frictional contact with the bevel polymer 104 formed on the edge of the wafer 102. As noted earlier, the frictional contact of the abrasive particles 105 on the bevel polymer 104, with a sufficient amount of chemicals (introduced through the support material of the composite applicator 106), will beneficially clean the wafer 102 edge of the bevel polymer 104.

Figure 4B:
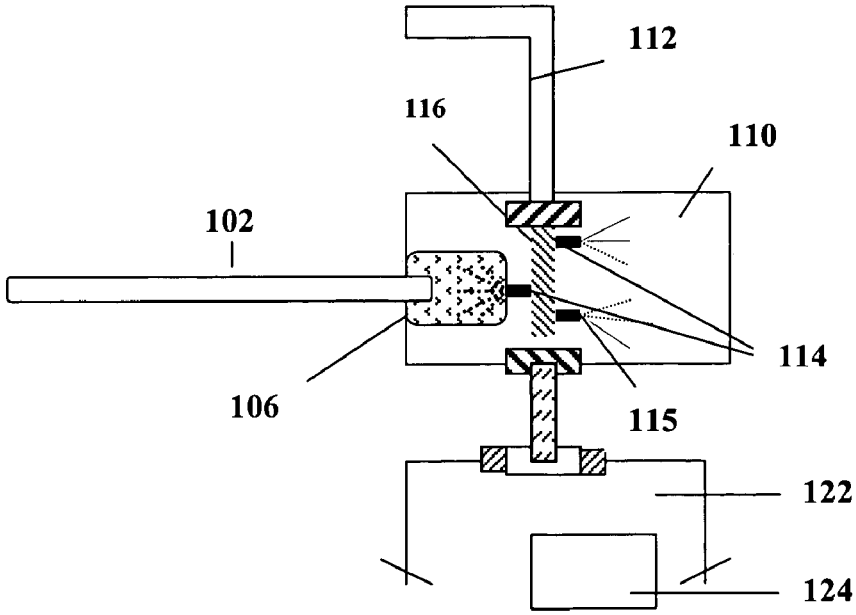
FIG. 4*b* illustrates the side cross-sectional view of a composite applicator, embedded in a solid material, receiving an edge of a wafer, in accordance with another embodiment of the present invention.

FIG. 4*b* represents another embodiment of the invention detailed in FIG. 4*a*. In this embodiment, the composite applicator 106 is embedded in a solid material 110 (e.g., a type of plastic or other chemically inert material), and allows the composite applicator 106 to spin along with the solid material 110 around the solid material's axis. In this embodiment, the liquid chemical introduced through the fluid distributor 116 is distributed to the composite applicator 106 through a tube 115 (or conduits/ports) embedded in or defined through the solid material 110. This tube 115 connects the composite applicator 106 to the fluid distributor 116 at aperture 114, enclosing the aperture 114 and allowing liquid chemical to flow from the fluid distributor 116 through the tube 115 to the composite applicator 106.

Figure 6:
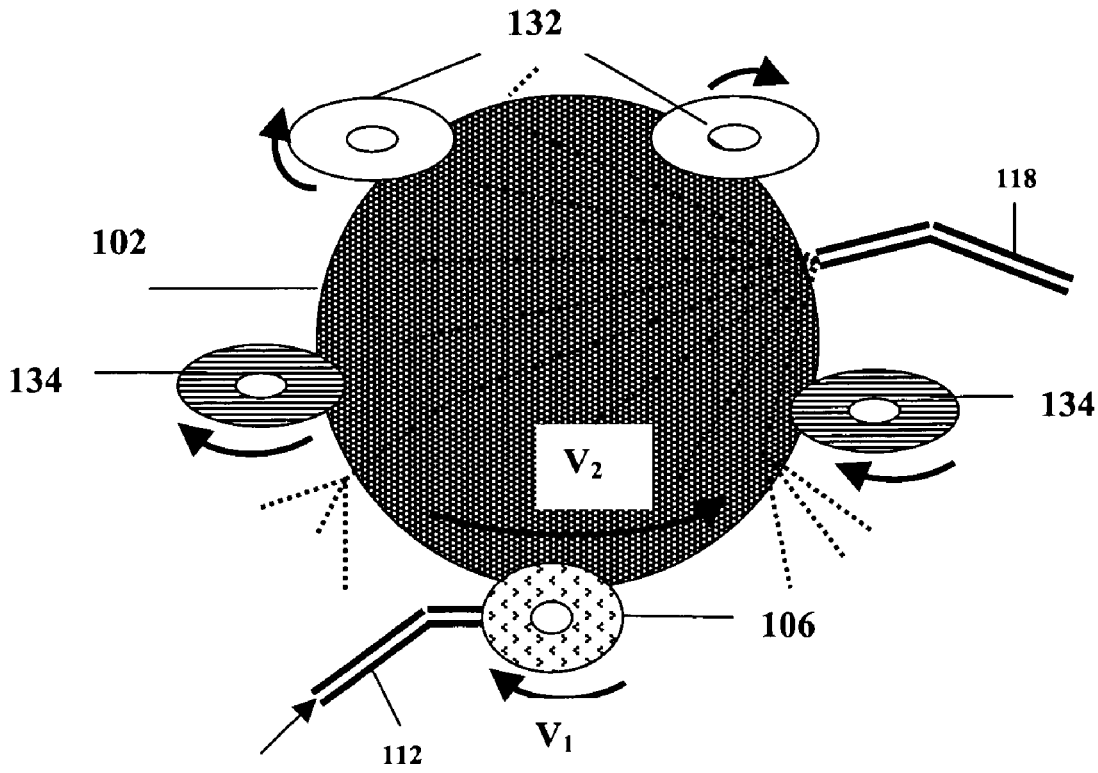
FIG. 6 illustrates the top view of a system with drive rollers, stabilizer wheels and composite applicator, in an embodiment of the present invention.

FIG. 6 shows the top view of a system used to clean an edge of a substrate. In this embodiment, a substrate supporting device is provided to receive and support the wafer 102 on a selected plane during the cleaning process. The substrate supporting device includes one or more drive rollers 132 distributed along the circumference of the wafer to allow the edge of the wafer 102 to be received. In this embodiment, a pair of drive rollers 132 has been used. These drive rollers 132 are profiled to fit the profile of the wafer edge and assist in spinning the wafer 102 around to expose different areas of the wafer edge to the composite applicator 106. Different configurations and positions for the drive rollers 132 are possible. A single drive roller or more than two drive rollers could also serve the purpose of the pair of drive rollers 132, as long as the wafer 102 is able to spin and expose different areas of wafer edge to the composite applicator 106. The spinning of the drive rollers 132 and the wafer edge could be by use of a motor 124 or by any other mechanical means. The substrate supporting device also includes one or more stabilizer wheels 134. In this embodiment, a pair of stabilizer wheels 134 has been used. The stabilizer wheels 134 are provided to stabilize the wafer 102 along a selected plane of rotation during the cleaning process. Different configurations and positions for the stabilizer wheels 134 are possible as long as the stabilizer wheels 134 are able to stabilize and maintain the wafer in the selected plane of rotation during the cleaning process. A composite applicator 106 is provided to receive the wafer edge. A channel 112, to introduce liquid chemicals into the support material of the composite applicator 106, is also provided. A nozzle 118 is also provided to spray the front side of the wafer 102 and wash away or dilute any liquid chemicals or solid particles that may make their way on to the front side of wafer 102 during treatment with the composite applicator 106. As the wafer 102 is rotating, centrifugal force will assist in the removal of liquid chemicals from the front side of the wafer. The nozzle 118 can be used to spray fluids, such as de-ionized water, or gases, such as gaseous nitrogen, onto the front side of the wafer 102 under variable pressure. Other fluids or gases may also be used to clean the surface of the wafer 102 as long as these fluids or gases are capable of efficiently removing or keeping away liquid chemicals from the front side of the wafer 102. The nozzle 118 can be placed anywhere in the system so long as it is able to efficiently spray and remove any unwanted chemicals that may make their way onto the front side of the wafer 102.

A method to clean the edge of wafer 102 is explained in great detail with reference to the system embodiment illustrated in FIG. 6. In this embodiment, an edge of a wafer 102, with bevel polymer 104 deposits, is applied to a composite applicator 106. One or more stabilizer wheels 134 are provided to support the wafer 102 along a selected plane. One or more drive rollers 132 receive the wafer edge and rotate the wafer along the selected plane. A nozzle 118 to spray fluid or gas onto the front side of wafer 102 is provided. A chemical fluid, such as liquid chemicals, is applied to the composite material (composite applicator 106) through a channel 112. Applying the chemical fluid to the composite material includes introducing the chemical fluid to the support material of the composite material 106 through the channel 112 and distributing it throughout the support material of composite material 106. Distribution can happen in one of two ways—a) allowing the chemical fluid to slowly seep through the porous support material; or b) providing a fluid distributor 116 (not shown in FIG. 6) with apertures 114 and introducing the chemical fluid through the channel 112, conducting it through the fluid distributor 116 and distributing the chemical fluid through the apertures 114 into the porous support material. The chemical fluids assist in lubricating the surface of the wafer 102 and in breaking-down the bevel polymer 104 from the edge of wafer 102.

During the cleaning process, the edge of the wafer 102 rotating at velocity $v_2$ is in tangential contact with the composite applicator 106 rotating at velocity $v_1$ with force F, while the stabilizer wheels 134 keep the wafer 102 steady along the selected plane of rotation and drive rollers 132 provide the force for the wafer 102 to rotate along the selected plane. The rotation of wafer 102, composite applicator 106, drive rollers 132 can be achieved by use of one or more motors 124 or by any other mechanical means.

The chemical fluid such as liquid chemicals in the support material of the composite applicator 106 interfaces with the edge of wafer 102 providing the lubrication to the surface of wafer 102 while chemically acting on the bevel polymer 104 on the edge of wafer 102 to cut the bond binding the bevel polymer 104 to the edge of wafer 102. The plurality of abrasive particles 105 distributed in the support material of the composite applicator 106 exposed to the edge of the wafer 102 and in frictional contact with the edge of wafer 102 simultaneously works to cut and tear the bevel polymer 104 from the edge of wafer 102. Continuous exposure of liquid chemicals weaken the bond binding the bevel polymer 104 to the edge of wafer 102 and the continuous frictional contact of the plurality of abrasive particles 105 exposed to the edge of the wafer 102 rips and tears the bevel polymer 104 from the edge of wafer 102 resulting in a substantially or completely bevel-polymer-free wafer edge.

The support material of the composite applicator 106 that is known to work in this embodiment illustrated in FIG. 6 is porous and formed from one of polyvinylalcohol, polyurethane, polymer resins or foams. The abrasive particles 105 have a hardness level greater than the hardness level of bevel polymer 104 on the edge of wafer 102 but less than a hardness level of the wafer 102. The abrasive particles 105 chosen have a hardness level between about 3 Mohs and 7 Mohs and are selected from a group consisting of titanium oxide, zirconium oxide, and amorphous silicon oxide. The liquid chemicals or chemical fluids that have shown promising results in the embodiments described in FIG. 6 are about 1% to about 29% by weight of Ammonium hydroxide to de-ionized water or about 1 part/1000 parts dilution of 49% by weight of Hydrogen fluoride to de-ionized water.

For more information on techniques used for cleaning edges of wafers, reference may be made to one or more of U.S. Pat. No. 6,910,240, U.S. Pat. No. 6,334,229, and U.S. Pat. No. 6,550,091, each of which is assigned to the assignee of the present invention and hereby incorporated by reference.

Although the foregoing invention has been described in some detail for purposes of clarity of understanding, it will be apparent that certain changes and modifications can be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. An apparatus for cleaning an edge of a substrate, comprising:

a composite applicator, including, a support material, the support material defining a body for the composite applicator, and the body being compliant when applied to the edge of the substrate so as to compress when contacting the edge of the substrate so that the edge of the substrate is at least partially pressed into the support material;

a plurality of abrasive particles distributed throughout and within the support material, the support material defining a contact surface that will expose one or more of the plurality of abrasive particles that are to be placed in frictional contact with the edge of the substrate, each of the plurality of abrasive particles having a hardness level that is less than a hardness level of the substrate, and a fluid distributor embedded in the support material to enable introduction and distribution of fluids to the support material from the inside so as to assist in cleaning the edge of the substrate.

2. An apparatus for cleaning an edge of a substrate as recited in claim 1, wherein the support material that defines the body is porous and formed from one of polyvinyl alcohol, polyurethane, polymer resins or foams.

3. An apparatus for cleaning an edge of a substrate as recited in claim 1, wherein the plurality of abrasive particles are selected from a group consisting of titanium oxide, zirconium oxide, and amorphous silicon oxide.

4. An apparatus for cleaning an edge of a substrate as recited in claim 3, wherein at least one of the plurality of abrasive particles has a hardness level greater than a hardness level of a bevel polymer built-up on the edge of the substrate.

5. An apparatus for cleaning an edge of a substrate as recited in claim 4, wherein the hardness level of at least one of the plurality of abrasive particles is between about 3 Mohs and about 7 Mohs.

6. An apparatus for cleaning an edge of a substrate as recited in claim 1, wherein the plurality of abrasive particles are distributed throughout in a random manner.

7. An apparatus for cleaning an edge of a substrate as recited in claim 1, wherein the fluids include liquid chemicals to facilitate chemical breakdown of a bevel polymer build-up on the edge of the substrate and lubrication of the substrate when the edge of the substrate is placed in contact with the support material.

8. An apparatus for cleaning an edge of a substrate as recited in claim 7, wherein the liquid chemicals to facilitate chemical breakdown of a polymer build-up on the edge of the substrate is one of ammonium hydroxide in aqueous solution or hydrogen fluoride in aqueous solution.

9. A system to clean an edge of a substrate, comprising:

a substrate supporting device to substantially receive and support the substrate in a selected plane; and a composite applicator, said composite applicator including, a support material, the support material defining a body for the composite applicator, and the body being compliant when applied to the edge of the substrate so as to compress when contacting the edge of the substrate so that the edge of the substrate is at least partially pressed into the support material;

a plurality of abrasive particles distributed throughout and within the support material, the support material defining a contact surface that will expose one or more of the plurality of abrasive particles that are to be placed in frictional contact with the edge of the substrate, each of the plurality of abrasive particles having a hardness level that is less than a hardness level of the substrate;

a channel to introduce fluids into the composite applicator, the fluids include chemicals that facilitate chemical reaction and lubrication during cleaning process; and a fluid distributor embedded in the support material of the composite applicator to enable distribution of fluids to the support material.

10. A system to clean an edge of a substrate as recited in claim 9, wherein the substrate supporting device to substantially receive and support the substrate in a selected plane includes one or more stabilizer wheels distributed around a circumference of the substrate to support and stabilize the substrate.

11. A system to clean an edge of a substrate as recited in claim 9, wherein the substrate supporting device to substantially receive and support the substrate in a selected plane includes one or more drive rollers in contact with the edge of the substrate, the one or more drive rollers distributed around a circumference of the substrate to rotate the substrate along the selected plane.

12. A system to clean an edge of a substrate as recited in claim 9, wherein the composite applicator is mounted on an indexing mechanism, the indexing mechanism permitting movement of composite applicator along an axis to provide a fresher composite applicator interface with the substrate.

* * * * *